US005709201A

United States Patent [19]

Puett, Jr.

[11] Patent Number: 5,709,201

[45] Date of Patent: Jan. 20, 1998

[54] METHOD AND APPARATUS FOR HEATING A LIQUID MEDIUM

[75] Inventor: Edwin E. Puett, Jr., Stuart, Fla.

[73] Assignee: Anser Thermal Technologies, Inc., Stuart, Fla.

[21] Appl. No.: 538,339

[22] Filed: Oct. 3, 1995

[51] Int. Cl.[6] ..... F24C 9/00

[52] U.S. Cl. ..... 126/247; 122/26

[58] Field of Search ..... 122/26, 247; 126/247

[56] References Cited

U.S. PATENT DOCUMENTS 4,357,931 11/1982 Wolpert et al. ..... 122/26

4,434,934 3/1984 Moser et al. ..... 126/247

*Primary Examiner*—Noah P. Kamen

*Attorney, Agent, or Firm*—Everett G. Diederiks, Jr.

[57] ABSTRACT

A heating apparatus draws in a liquid medium through a motor driven, high pressure pump, the liquid medium is greatly increased in pressure and temperature through frictional heating thereof and then the liquid medium is discharged in a heated, reduced pressure state for use directly or for heat exchange with another fluid. A method of utilizing the heating apparatus is also disclosed.

19 Claims, 4 Drawing Sheets

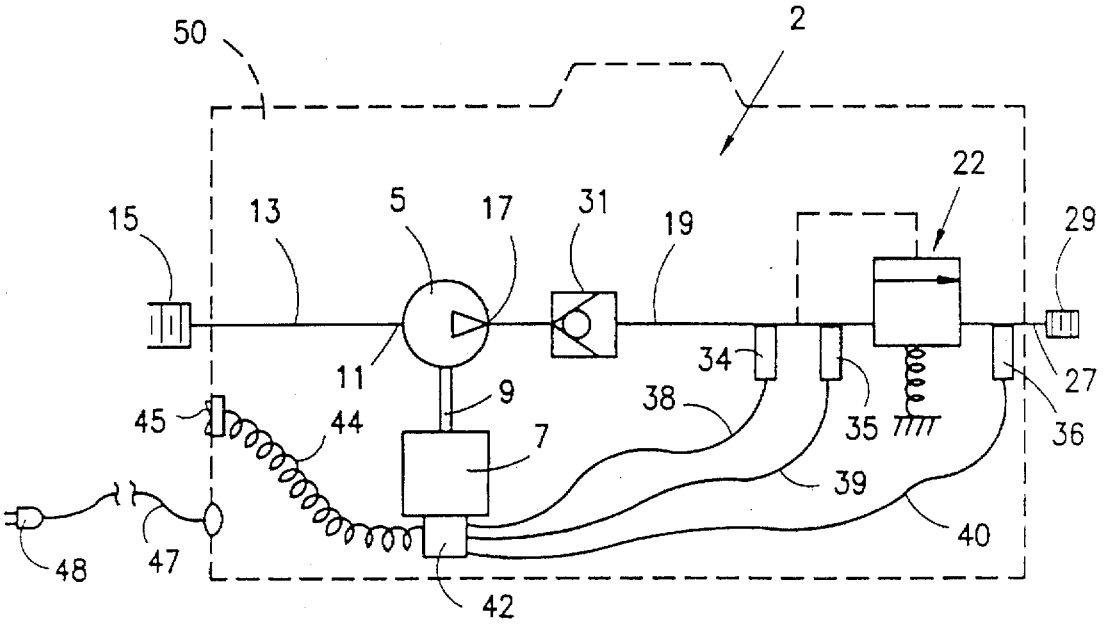
FIG. 1
FIG. 2
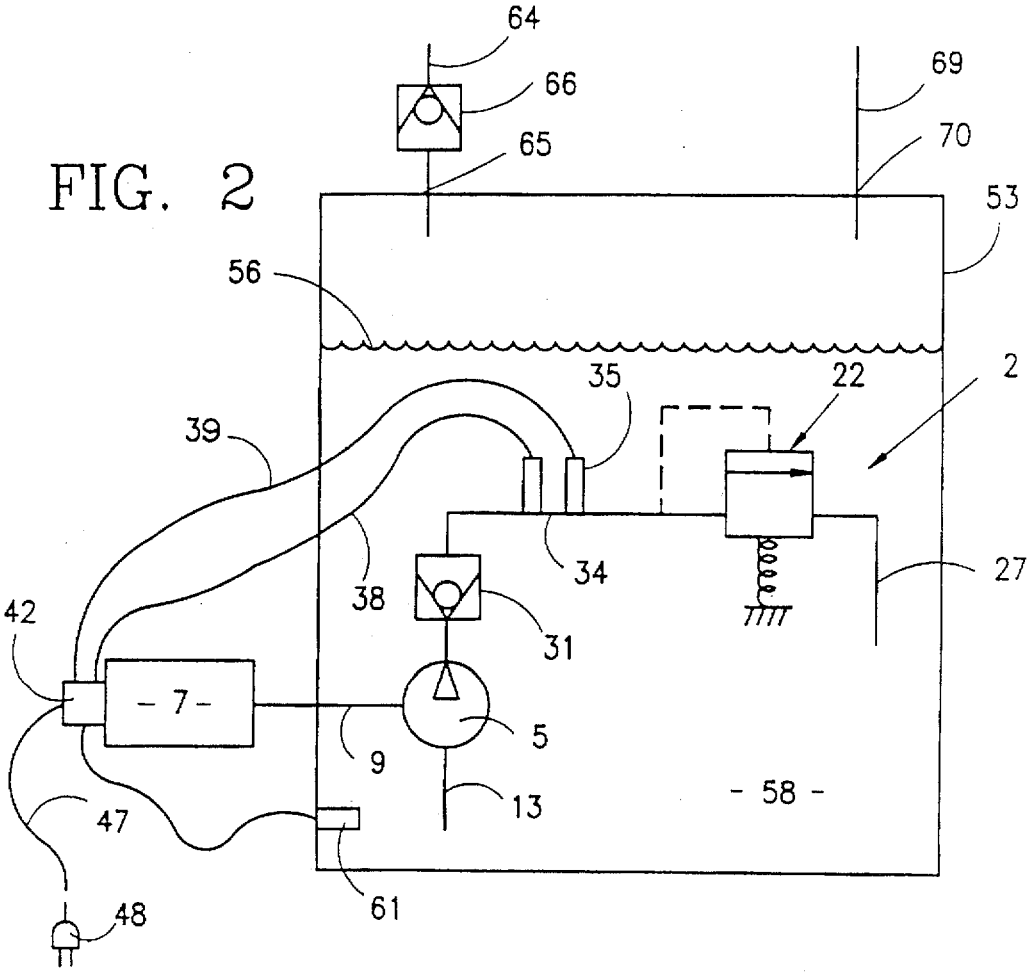

METHOD AND APPARATUS FOR HEATING A LIQUID MEDIUM

BACKGROUND OF THE INVENTION

1. Field of the Invention

The present invention pertains to an apparatus for generating heat through the use of friction for the purpose of heating a liquid medium, as well as a method for heating a liquid medium.

2. Discussion of the Prior Art

There are an abundance of applications that require the generation and transferring of heat. For example, to name just a few, systems for heating buildings, clothes dryers and water heating units require the generation of heat to warm a fluid medium generally constituted by water or air. Such known arrangements utilize various types of heat sources. For instance, the use of electrical resistance elements, oil and various type of gas burners are widely known.

Electrical resistance elements are rather inexpensive, can develop high temperatures in rather short time periods and can be readily supplied with electrical operating power. However, such resistance elements have high power consumption rates and are therefore quite costly to operate as compared to other available heating arrangements. Oil and gas burner units can be more cost effective to operate than electrical resistance based units, but oil and gas burner units also have their drawbacks such as limitations based on availability of the respective combustible fluids in particular localities, the potential for operating cost fluxuations based on various global factors and the bulkiness of the overall units.

Based simply on the above, it should be readily apparent that each of the commonly known heating arrangements has its associated advantages and disadvantages. In general, operational efficiencies must be compromised if operational costs are to be minimized. Furthermore, the overall compactness of prior art units represents a significant limitation. Therefore, there exists a need in the art for a compact fluid heating apparatus which is both cost and operationally efficient, while being readily adaptable for various uses in today's marketplace.

SUMMARY OF THE INVENTION

The method and apparatus for heating a liquid medium in accordance with the present invention is based upon the concept of utilizing the heat generated through frictional forces acting on the liquid medium. According to the invention, a fluid medium is drawn into a motor driven, high pressure pump at an initial pressure. The pressure of the liquid medium is greatly increased, generally in the range of fifteen to one hundred-fifty times the initial pressure, and its temperature substantially increased due to frictional forces acting thereon as it is retained in a confined volume defined between the pump and a pressure relieving unit. The liquid medium is permitted to pass through the pressure relieving unit which greatly reduces the pressure of the liquid medium while further heating the liquid medium by means of the frictional forces acting between the liquid medium and the pressure relieving unit.

The heated medium can be constituted by various liquids and can be used for various purposes. For example, in the simplest form of the invention, the liquid medium would constitute water which would simply be heated to various degrees depending on a desired output temperature with the temperature being readily varied, for instance, depending upon the pressure rise/reduction range utilized. Since only a motor, pump and pressure relief unit are required, the apparatus can be made quite compact and mobile. Such an apparatus can have various beneficial uses, for instance as a portable heating supply that can be readily hooked-up to a standard garden hose to provide for a constant supply of heated water such as for washing vehicles or the like, to replace a standard hot water heater in a home and in a pool heating system.

The heated liquid medium may also be used to heat another liquid medium. For example, after being heated, the liquid medium could be directed through a heat exchanger for use in heating another medium. Such an arrangement would also have numerous applications from a building heating system wherein the heat from the heated liquid is conducted to another medium such as air which is then blown into desired heating areas, to a home hot water system that incorporates a storage tank, to a clothes dryer and a boiler to name a few. In these applications, the preferred liquid medium is hydraulic fluid and is designed to replace conventional liquid heating arrangements while representing a more compact and energy efficient system.

Additional features and advantages of the invention will become more readily apparent from the following detailed description thereof when taken in conjunction with the following drawings which show the versatility of the invention by illustrating the same for use in various environments.

BRIEF DESCRIPTION OF THE DRAWINGS

FIG. 1 schematically illustrates the liquid heating apparatus of the invention in accordance with a first embodiment thereof.

FIG. 2 is a schematic of the heating apparatus illustrated for use in a boiler.

DETAILED DESCRIPTION OF THE PREFERRED EMBODIMENTS

Figure 3:
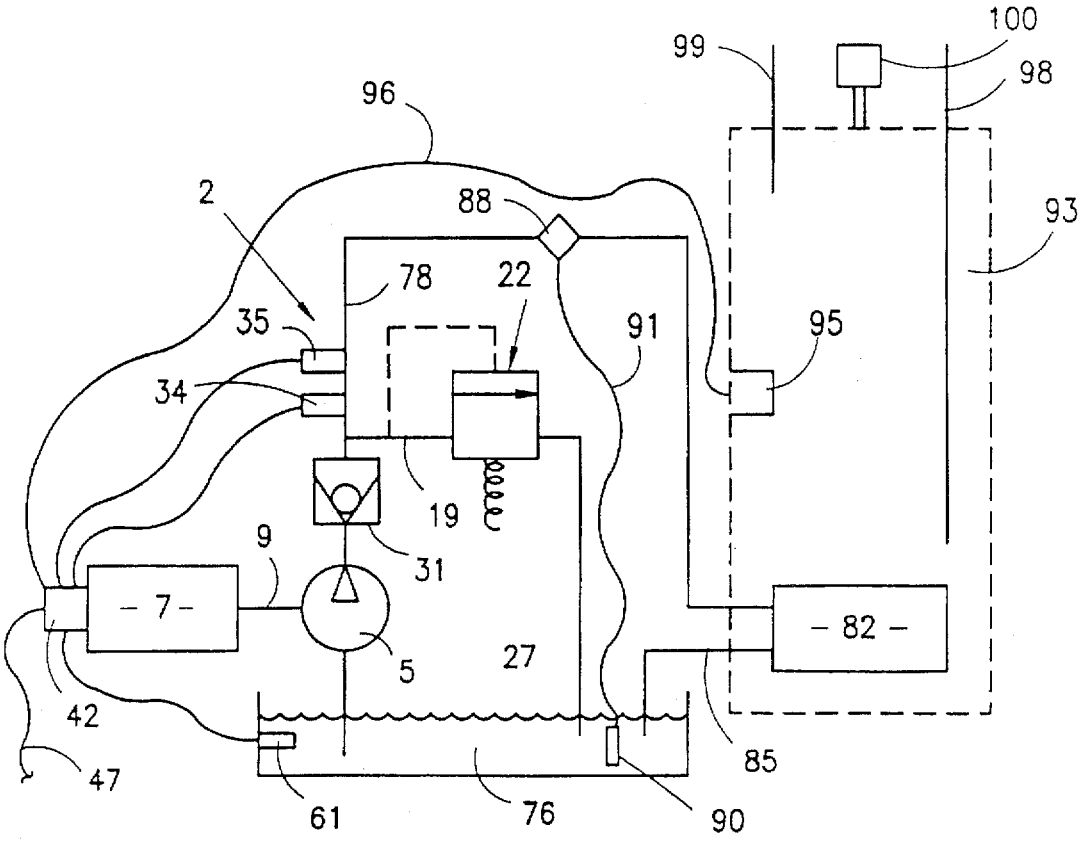
FIG. 3 is a schematic of the heating apparatus illustrated for use in a hot water heating system.

With initial reference to FIG. 1, the liquid heating apparatus of the invention is generally indicated at 2. Apparatus 2 includes a high pressure pump 5 that is adapted to be driven by an electric motor 7 through a shaft 9. Pump 5 includes an inlet port 11, connected to an inlet line 13 carrying a first connector 15, and an outlet port 17 connected to a liquid passage 19.

Downstream of pump 5, passage 19 leads to a unit that is adapted to retain a liquid delivered into passage 19 by pump 5 until the temperature and pressure of the liquid are raised desired amounts. In the embodiment depicted in this figure, this retaining unit is constituted by a pressure relief valve 22 which is fluidly connected to an output line 27 having a second connector 29, however, other types of valving arrangements including needle valve, orifices or other types of flow restricting valves could also be utilized. Since the particular structure of pressure relief valve 22 is known in the art, it will not be detailed herein. Although the full operation of apparatus 2 will be detailed below, at this point it is important to note that valve 22 will prevent a liquid drawn through pump 5 into passage 19 from exiting passage 19 until the liquid has been heated by frictional forces acting on the liquid by means the operation of pump 5 and the presence of valve 22.

In accordance with the invention, valve 22 is pre-set to a predetermined relief pressure or flow restricting degree depending on the particular use of apparatus 2 and the specific liquid utilized therewith. The apparatus 2 of FIG. 1 is particularly adapted for use as an in-line water heater, either as a portable unit wherein first and second connectors 15 and 29 are adapted to be readily connected to standard garden hoses or as a home hot water supplying arrangement. In either case, the water connected to inlet line 13 will typically be at approximately 20 psi and about 50° F. Knowing these parameters and the desired output temperature of the liquid will enable the size of pump 5 and the preset pressure relief level to be selected. For example, for home water heating wherein a maximum output temperature for the liquid of approximately 140° F. is desired, pump 5 will operate at a rate corresponding to pumping approximately 8 gallons per minute and valve 22 is set at approximately 1500 psi and will allow a continuous output flow of heated water at the rate of approximately 2 gallons per minute at 20 psi. Of course, these test numbers are presented for exemplary purposes only and the actual pumping rate, the set pressure relief level, output temperature and output flow rate can be readily determined experimentally.

In addition to the structure discussed above, preferably interposed between pump 5 and valve 22 is a check valve 31 which prevents back pressure on pump 5, particularly after motor 7 de-activated, so as to unload the pump 5 and motor 7. In addition, to provide automatic control and for safety reasons, one or more sensors 34–36 is provided and signal, through respective lines 38–40, a relay switching unit 42 for controlling the de-activation of motor 7. When apparatus 2 is used as a portable water heater, relay switching unit 42 is connected through an electrical line 44 to an ON/OFF switch 45 that is also connected to a power cord 47 having a plug 48. The entire heater structure can be located within a portable housing 50.

As indicated above, sensors 34–36 are provided for safety reasons and, more specifically, to prevent the possibility of the liquid from being heated or pressurized to a dangerous level due to a potential malfunction of one of the components of heating apparatus 2. In the preferred embodiment shown, sensor 34 constitutes a pressure sensor, sensor 35 constitutes a temperature sensor and sensor 36 constitutes a temperature sensor. In any event, various types of sensors can be utilized and only one such sensor need be provided, preferably either pressure sensor 34 or temperature sensor 35, for safety reasons, with other sensors merely providing an added level of safety. The heating apparatus 2 of FIG. 1 has been found to continuously provide a supply of heated water with a greatly reduced power consumption rate over known hot water heaters. In addition, heating apparatus 2 is extremely compact and lightweight so that it is readily portable.

FIGS. 2–7 illustrate other exemplary uses for heating apparatus 2 as will be discussed below. Since the heating apparatus 2 can be used in many environments with little or no change in its structure or function, like reference numerals will be used to represent corresponding structure to that described above and therefore this corresponding structure will not be reiterated.

FIG. 2 illustrates heating apparatus 2 used in a boiler for generating a supply of steam. In this embodiment, a tank 53 defines a closed chamber that is filled with a liquid medium to a level 56 so as to define a reservoir 58. The apparatus 2 functions as described above to heat the liquid to a predetermined temperature that is greater than the boiling point of water and measured by a thermo-sensor 61 which sends a signal to relay switching unit 42 to de-activate motor 7 when this temperature is reached in reservoir 58. A water inlet line 64 extends into tank 53 through an inlet port 65 and a one-way check valve 66. A steam outlet line 69 extends from an outlet port 70 of tank 53.

In the preferred embodiment of FIG. 2, the liquid medium that is heated constitutes water, however, it is easily possible to utilize other liquids such as hydraulic fluid or an ammonia based liquid and to simply arranged this heated liquid in heat exchange relationship with the incoming water entering tank 53 through inlet line 64 in order to generate the desired steam.

FIG. 3 illustrates an embodiment wherein the heating apparatus 2 is used as the heat source for a conventional hot water heater. In this embodiment, a reservoir 76 of fluid, preferably hydraulic fluid, is provided through which pump 5 draws the liquid medium to be heated. Here, liquid passage 19 is fluidly connected to a liquid conduit 78 that leads to a heat exchanger 82. Heat exchanger 82 also has associated therewith a return conduit 85 that leads back to the reservoir 76. In the preferred embodiment shown, located in liquid conduit 78 is an solenoid valve 88 which is connected to a thermocouple 90 located in reservoir 76 through a signal line 91.

Heat exchanger 82 is positioned in a hot water tank 93 and is therefore in heat exchange relationship with water placed in the hot water tank 93. A temperature sensor 95 is also positioned in hot water tank 93 and is connected through a line 96 to relay switching unit 42. The water for hot water tank 93 is provided via an inlet line 98 and the flow of water from hot water tank 93 is taken through outlet line 99. Also shown at 100 is a pressure relief for the hot water tank 93.

The manner of operation of the system depicted in the embodiment of FIG. 3 will now be described. The system is designed to be operate automatically and to be an alternative to a conventional hot water heater. The supply of water into and out of hot water tank 93 is as conventionally known and therefore need not be described. When temperature sensor 95 indicates that the water in tank 93 needs to be heated (which temperature is generally adjustable), a signal is sent through line 96 to relay switching unit 42 in order to activate motor 7 and pump 5. At the same time, thermocouple 90 will sense the temperature of the liquid medium in reservoir 76. If the temperature signaled by thermocouple 90 is above a prescribed limit needed to sufficiently heat the water in tank 93 (generally in the order of 160° F.), solenoid valve 88 will open liquid conduit 78 and the pumped liquid medium will flow to the heat exchanger 82 to heat the water in tank 93 as desired. Preferably, a fraction of the pumped liquid will still flow through liquid passage 19 to be further heated as well.

If the temperature in reservoir 76 is below the prescribed temperature, solenoid valve 88 will remain closed and all the liquid pumped will have to flow through liquid passage 19 and therefore will be heated in the manner described above. This recirculation process will then continue until the temperature in the reservoir 76 is high enough to open solenoid valve 88. If the temperature in reservoir gets dangerously high as sensed by thermosensor 61, motor 7 will be de-activated as described above with respect to the FIG. 2 embodiment. In addition, additional sensors 34 and 35 are shown here, while sensor 36 has not been shown for simplicity of the drawing.

Figure 4:
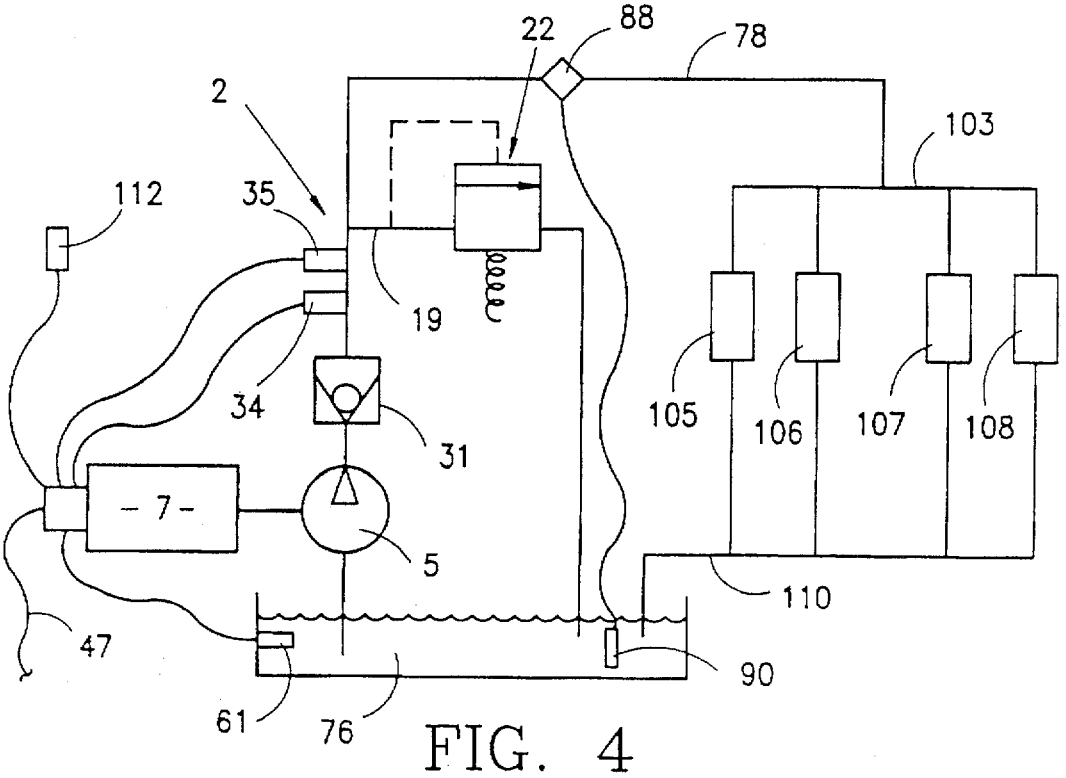
FIG. 4 is a schematic of the heating apparatus illustrated for use in a radiant heating system.

The embodiment of FIG. 4 represents utilizing the heating apparatus 2 in a radiant heating system. The heating apparatus 2 is arranged and works essentially the same in this embodiment as that described above with respect to the FIG. 3 embodiment, except as mentioned below. Liquid conduit 78 flows into a branch line 103 that lead through sub-conduits (not labeled) to a plurality of radiant heat exchangers 105–108 arranged in parallel. Each heat exchanger 105–108 leads to a common return line 110 to deliver the liquid medium back to the reservoir 76. In addition, no corresponding temperature sensor to sensor 95 is utilized here. Instead, motor 7 is controlled during normal operation depending on the setting of a thermostat such as that indicated at 112.

In this embodiment, when the temperature in a heating zone such as a area in a home is below a desired temperature set at thermostat 112, motor 7 will kick on. Pump 7 will then recirculate the liquid medium to the reservoir 76 until the same is heated to a predetermined temperature. Once this temperature is reached, solenoid valve 88 will open liquid conduit 78 and the heated liquid medium can readily flow to the heat exchangers 105–108 which essentially constitute radiators arranged throughout the heating zone. In all other aspects, the heating apparatus of FIG. 4 functions as previously described.

Figure 5:
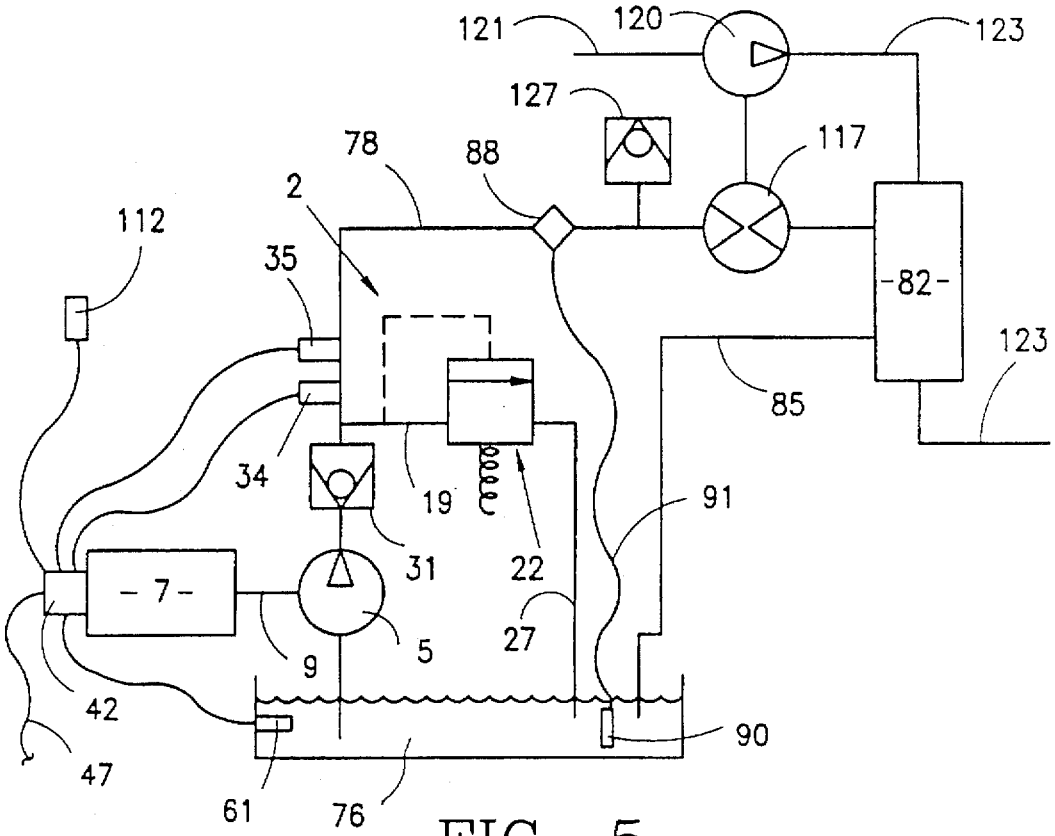
FIG. 5 is a schematic of the heating apparatus illustrated for use in heating pool water.

The embodiment of FIG. 5 is presented to illustrate the use of heating apparatus 2 in a pool, spa or the like water heating environment. Again heating apparatus 2 essentially works in the same manner as that described above, but located downstream of solenoid valve 88 and before heat exchanger 82 is a fluid motor 117. Since the liquid medium used is preferably an hydraulic fluid, motor 117 constitutes an hydraulic motor of preferably fixed displacement. Fluid motor 117 is driven when the liquid medium is sent through liquid conduit 78 upon the opening of valve 88. Here, however, thermostat 112 is adjusted to set a desired water temperature for the pool, spa or the like.

Fluid motor 117 is drivingly connected to a water pump 120 having an associated inlet line 121 and a water outlet line 123 with the water outlet line 123 being in heat transfer relationship with heat exchanger 82 for heating of the water flowing therethrough. Again, operation of the heating apparatus 2 in accordance with this embodiment will not be reiterated here given the detailed description provided above and the clearly analogous structure and function. It should be noted, however, that liquid conduit 78 is provided with an anti-cavitation device in the form of a check valve 127 which opens the inlet to fluid motor 117 to either atmosphere (as shown) or reservoir 76 when there is no pressure in the line due to the closing of solenoid valve 88. This structure is provided to simply provide a more quite operation as fluid motor 117 runs down due to built-up momentum following the closing of solenoid valve 88 and commensurate loss of driving fluid for fluid motor 117. Finally, it should be readily apparent that thermostat 112 could operate on a timer basis without affecting the overall operation of the invention and solenoid valve 88 could be opened, either fully or partially, and motor 7 could be readily controlled to operate in a non-heating mode to simply circulate the pool water, such as by providing a valve at the juncture of liquid passage 19 and liquid conduit 78 to prevent flow through passage 19.

Figure 6:
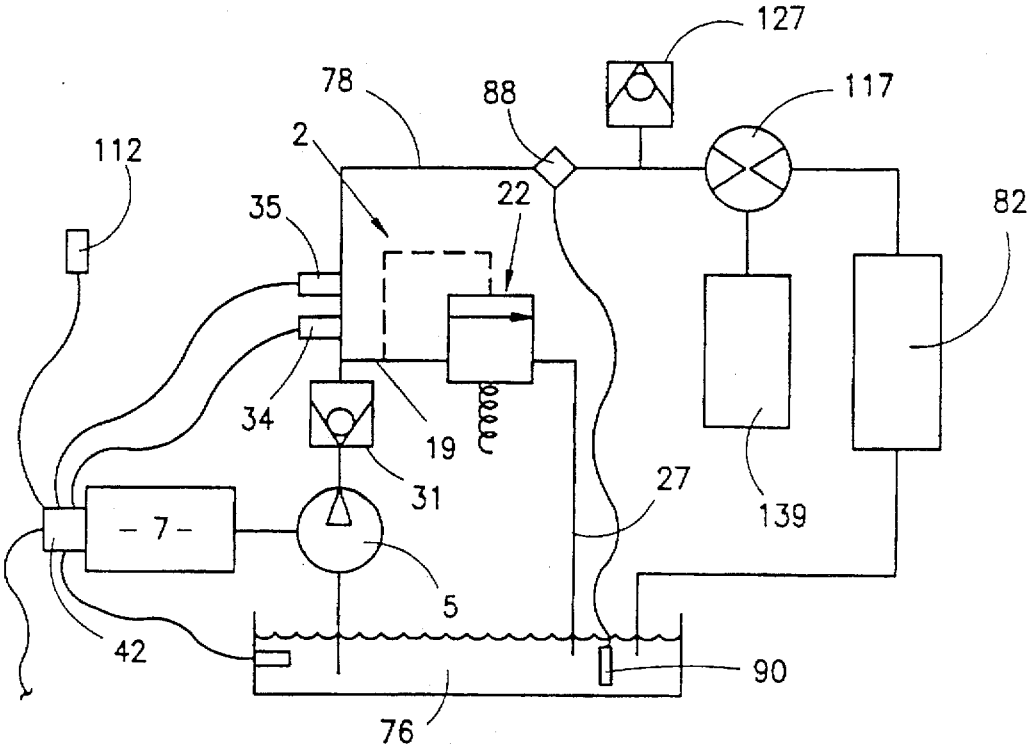
FIG. 6 is a schematic of the heating apparatus according to a sixth embodiment wherein the heating apparatus forms part of an air heating arrangement.
Figure 7:
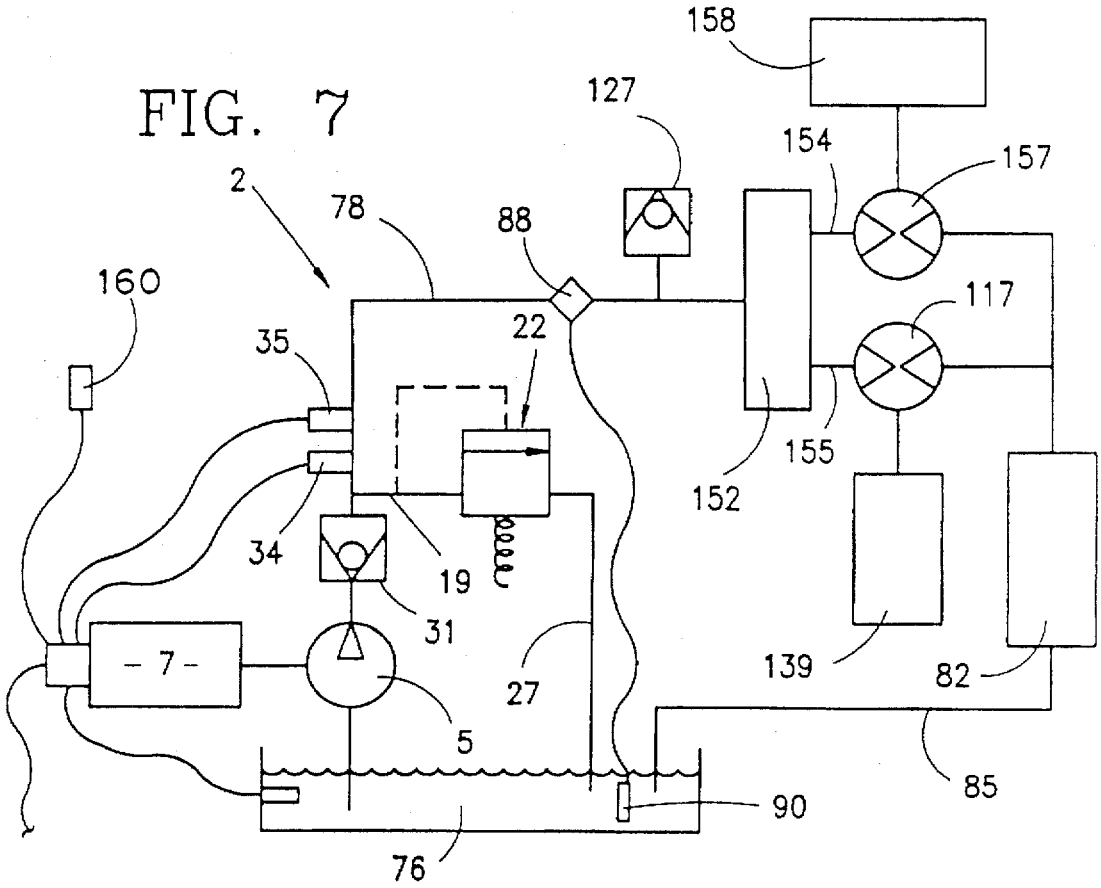
FIG. 7 is a schematic of the heating apparatus of the invention incorporated in a clothes dryer.

The embodiment of FIG. 6 is almost identical to the arrangement described above with reference to FIG. 5 except that fluid motor 117 drives a blower 139 that directs a flow of air over heat exchanger 82 such that a forced air heating system is provided. In initial testing of a heating apparatus 2 constructed in accordance with this embodiment, it has been found that a conventional forced air heating system incorporating a resistance heating element can be replaced in accordance with the present invention and operated at well below, i.e. approximately half, the cost associated with operating the conventional system. Again, this arrangement could also readily be used for simply driving blower 139 in a fan or air circulating mode.

As mentioned above, FIG. 7 illustrates the heating apparatus 2 of the present invention incorporated in a clothes dryer. In accordance with this embodiment, a flow divider 152 is provided in liquid conduit 78 downstream of solenoid valve 88 to divide liquid conduit 78 into sub-conduits 154 and 155. Sub-conduit 154 leads to a second fluid motor 157 which is adapted to drive a rotary drum 158 of the clothes dryer. Sub-conduit 155 leads to a fluid motor 117 which drives blower 139. Blower 139 functions in this embodiment to direct a flow of heated air into rotary drum 158 commensurate with the operation of known clothes drying units. Finally, in this embodiment, the thermostat of the above-described embodiments is replaced with a timer unit 160 provided on a conventional clothes dryer control panel. Again, the operation of the heating apparatus 2 in accordance with this embodiment is the same as that described above given the like reference numerals which refer to corresponding parts in the several embodiments and therefore the operation will not be further described here.

From the above description of numerous embodiments of the invention, it should be readily apparent that the heating apparatus 2 of the present invention is versatile and can readily supply a heated fluid which can be used for various purposes either directly or as a medium for heating another fluid. Furthermore, the heating apparatus is extremely compact and energy efficient. However, although described with respect to preferred embodiments of the invention, it should be readily understood that various changes and/or modifications may be made to the invention without departing from the spirit thereof. In general, the invention is only intended to be limited by the scope of the following claims.

I claim:

1. An apparatus for heating a liquid medium comprising:

a liquid passage;

means for drawing a liquid medium into said liquid passage at a first pressure and a first temperature;

means for retaining said liquid medium in said liquid passage until said liquid medium is pressurized to a second pressure which is multiple times higher than said first pressure and frictionally heated to a second temperature which is greater than said first temperature;

means for releasing said liquid medium in a heated state from said liquid passage at a third pressure which is lower than said second pressure;

a first fluid motor arranged in fluid communication with said liquid passage, wherein said first fluid motor is adapted to be driven by said liquid medium;

means for sensing an operating parameter of said liquid medium downstream of said drawing means; and means for automatically controlling the operation of said drawing means based on the sensed operating parameter.

2. The apparatus according to claim 1, wherein each of said retaining means and said releasing means comprises, at least in part, a portion of a pressure reducing valve arranged in said liquid passage downstream of said drawing means.

3. The apparatus according to claim 1, wherein said apparatus is adapted to develop said second pressure in a range of 300 psi to 3,000 psi.

4. The apparatus according to claim 1, wherein said apparatus is adapted to develop said second temperature in a range of 20° to 220° F.

5. The apparatus according to claim 1, further comprising a reservoir, said drawing means taking the liquid medium from said reservoir and said releasing means delivering the liquid medium back to said reservoir.

6. The apparatus according to claim 5, further comprising:

a liquid conduit adapted to receive a flow of said liquid medium, said first fluid motor being connected to said liquid conduit;

a heat exchanger having an inlet and an outlet with said inlet being attached to said liquid conduit and said outlet leading to said reservoir; and means for controlling the flow of said liquid medium within said liquid conduit.

7. The apparatus according to claim 6, wherein said liquid conduit is connected to said liquid passage between said drawing means and said releasing means and wherein said means for controlling the flow of said liquid to said liquid conduit comprises at least one valve located in said liquid conduit between said liquid passage and said liquid conduit.

8. The apparatus according to claim 6, further comprising a plurality of heat exchangers connected in parallel to said liquid conduit, each of said heat exchangers including an outlet leading to said reservoir.

9. The apparatus according to claim 6, further comprising:

a flow divider splitting said liquid conduit into first and second sub-conduits; and a second fluid motor, said first and second fluid motors being arranged in fluid communication with said first and second sub-conduits respectively such that said first and second fluid motors are driven when the liquid medium flows through said first and second sub-conduits.

10. The apparatus according to claim 9, further comprising, in combination, a rotary drum drivingly connected to said first fluid motor and a blower unit drivingly connected to said second fluid motor, said blower unit being adapted to develop a flow of air that is directed into said drum while being in heat exchange relationship with said heat exchanger.

11. The apparatus according to claim 7, further comprising a pump means, drivingly connected to said fluid motor, for drawing in a flow of water and pumping the water into heat exchange relationship with said heat exchanger.

12. The apparatus according to claim 7, further comprising an air blower unit drivingly connected to said fluid motor for creating a flow of air directed at said heat exchanger.

13. An apparatus for heating a liquid medium comprising:

a liquid passage;

means for drawing a liquid medium in said liquid passage at a first pressure and a first temperature;

means for retaining said liquid medium in said liquid passage until said liquid medium is pressurized to a second pressure which is multiple times higher than said first pressure and frictionally heated to a second temperature which is greater than said first temperature;

means for releasing said liquid medium in a heated state from said liquid passage at a third pressure which is lower than said second pressure;

a reservoir, said drawing means taking the liquid medium from said reservoir and said releasing means delivering the liquid medium back to said reservoir;

means for sensing an operating parameter of said liquid medium downstream of said drawing means; and means for automatically controlling the operation of said drawing means based on the sensed operating parameter, wherein said liquid passage is immersed in said reservoir which defines an enclosed chamber with the liquid medium extending up to a first level in said chamber, said chamber being provided with inlet and outlet ports with at least said outlet port being located above said first level.

14. An apparatus for heating a liquid medium comprising:

a liquid passage;

means for drawing a liquid medium into said liquid passage at a first pressure and a first temperature;

means for retaining said liquid medium in said liquid passage until said liquid medium is pressurized to a second pressure which is multiple times higher than said first pressure and frictionally heated to a second temperature which is greater than said first temperature;

means for releasing said liquid medium in a heated state from said liquid passage at a third pressure which is lower than said second pressure;

a reservoir, said drawing means taking the liquid medium from said reservoir and said releasing means delivering the liquid medium back to said reservoir;

a liquid conduit adapted to receive a flow of said liquid medium;

a heat exchanger having an inlet and an outlet with said inlet being attached to said liquid conduit and said outlet leading to said reservoir;

means for controlling the flow of said liquid medium within said liquid conduit;

means for sensing an operating parameter of said liquid medium downstream of said drawing means;

means for automatically controlling the operation of said drawing means based on the sensed operating parameter; and said apparatus further comprising, in combination, a hot water tank, said heat exchanger being arranged within said hot water tank.

15. A method of heating a liquid medium comprising:

delivering a liquid medium into a liquid conduit at a first pressure and a first temperature;

pressurizing the liquid medium within the conduit to multiple times higher than said first pressure while frictionally heating the liquid medium to a second temperature which is greater than said first temperature;

outputting the liquid medium, in a heated state, at a pressure within five times said first pressure;

driving a fluid motor by the liquid medium;

sensing an operating parameter of said liquid medium; and controlling the delivery of the liquid medium into the liquid conduit based on the sensed operating parameter of said liquid medium.

16. The method of claim 15, further comprising:

drawing the liquid medium from a reservoir and returning the liquid medium, in its heated state, back to the reservoir.

17. The method of claim 15, further comprising:

directing the liquid medium in a heated state into a heat exchanger.

18. The method of claim 17, further comprising:

driving a blower unit by said fluid motor; and directing a flow of air developed by operation of said blower unit into heat exchange relationship with said heat exchanger.

19. A method of generating and exchanging heat comprising:

sensing a desired heating condition for a zone;

drawing a liquid from a reservoir by means of a motor driven pump;

frictionally heating and raising the pressure of said liquid;

directing output flow from the pump back to the reservoir;

continuing to drawing the liquid from the reservoir and frictionally heating the liquid until at least the liquid becomes heated to a predetermined temperature;

sensing when the liquid has reached the predetermined temperature;

activating a control member to cause a fluid to flow in heat exchange relationship with the liquid;

directing the fluid into said zone; and sensing when the desired heating condition for the zone is reached and then de-activating the motor driven pump.

* * * * *